US009636725B2

(12) United States Patent
Zanella et al.

(10) Patent No.: US 9,636,725 B2
(45) Date of Patent: May 2, 2017

(54) ROLLING PLANT, ROLLING MILL AND ROLLING METHOD

(71) Applicant: SMS INNSE S.P.A., San Donato Milanese (IT)

(72) Inventors: Guido Emilio Zanella, Milan (IT); Vincenzo Palma, Sesto San Giovanni (IT); Marco Ghisolfi, Muggiò (IT)

(73) Assignee: SMS INNSE S.P.A., San Donato Milanese (IT)

( * ) Notice: Subject to any disclaimer, the term of this patent is extended or adjusted under 35 U.S.C. 154(b) by 15 days.

(21) Appl. No.: 14/427,616

(22) PCT Filed: Aug. 28, 2013

(86) PCT No.: PCT/IB2013/058076

§ 371 (c)(1),
(2) Date: Mar. 11, 2015

(87) PCT Pub. No.: WO2014/045140

PCT Pub. Date: Mar. 27, 2014

(65) Prior Publication Data

US 2015/0246381 A1 Sep. 3, 2015

(30) Foreign Application Priority Data

Sep. 19, 2012 (IT) ..... MI2012A1559

(51) Int. Cl.
*B21B 19/04* (2006.01)
*B21B 17/04* (2006.01)
*B21B 37/16* (2006.01)

(52) U.S. Cl.
CPC ..... *B21B 19/04* (2013.01); *B21B 17/04* (2013.01); *B21B 37/16* (2013.01)

(58) Field of Classification Search
CPC ..... B21B 19/04; B21B 37/16; B21B 17/04
(Continued)

(56) References Cited

FOREIGN PATENT DOCUMENTS

EP 001779939 A1 * 5/2007
EP 1779939 A1 5/2007
(Continued)

OTHER PUBLICATIONS

International Search Report for Application No. PCT/IB2013/058076, mailed May 28, 2014.

*Primary Examiner* — David B Jones
(74) *Attorney, Agent, or Firm* — Perkins Coie LLP; Viola T. Kung; Andrew T. Pettit

(57) ABSTRACT

The invention relates to a pipe rolling plant 10 comprising a rotary piercer 20, a treatment station 30 and a main rolling mill 40. The rotary piercer and the treatment station are arranged so that the pierced blank 51 leaving them is arranged with the irregular tail 511 facing the main rolling mill 40 and with the regular head 510 facing the mandrel 41. The invention also relates to a rolling mill 40 comprising a plurality of rolling stations 43, each station comprising a plurality of rolling rolls 42, the radial position h of which is adjustable. The rolling mill also comprises a control circuit for calculating and/or measuring the distance d between the axes of rotation r of the rolls and the trailing edge 520 of the pipe 52. The control circuit is also designed to displace the rolling rolls radially towards the outside of the pipe in each rolling station $\mathbf{43}_n$ when the distance d assumes a predetermined value $d_0$.

4 Claims, 5 Drawing Sheets

(58) Field of Classification Search
USPC ..... 72/96, 97, 208, 209
See application file for complete search history.

(56) References Cited

FOREIGN PATENT DOCUMENTS

| | | | |
|---|---|---|---|
| WO | 9318870 | A1 | 9/1993 |
| WO | 03057383 | A1 | 7/2003 |

* cited by examiner

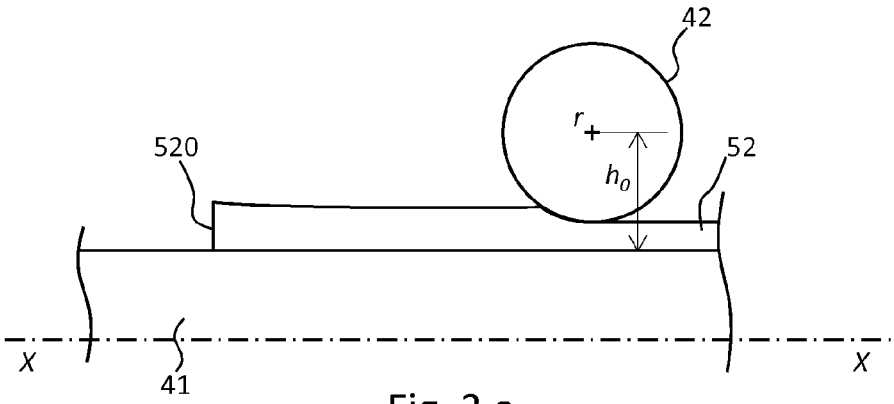
Fig. 3.a
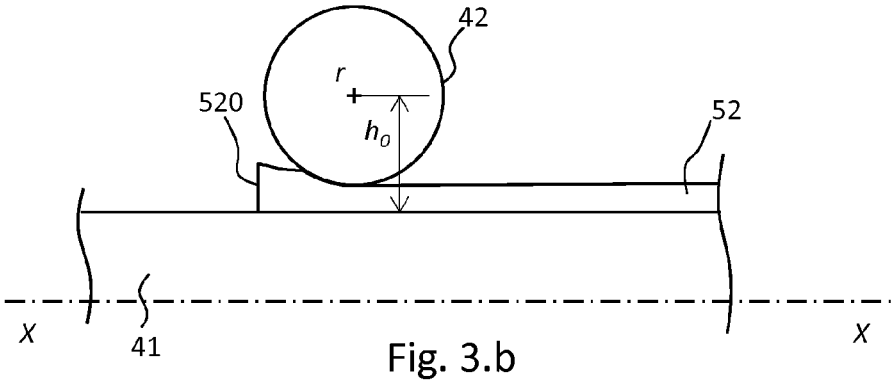
Fig. 3.b
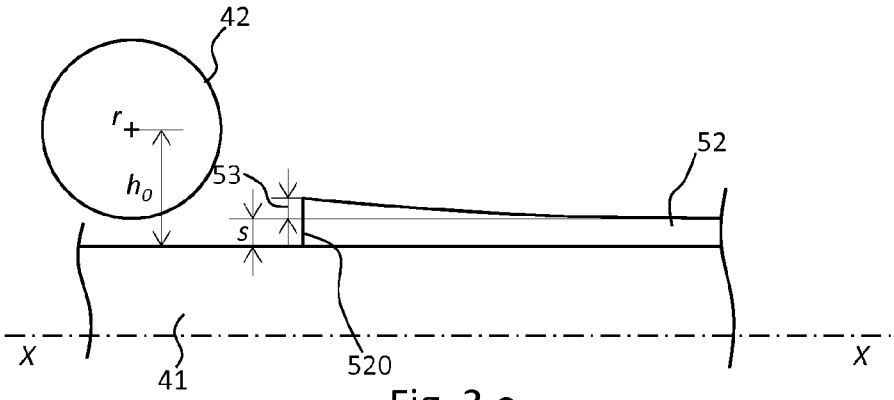
Fig. 3.c
PRIOR ART

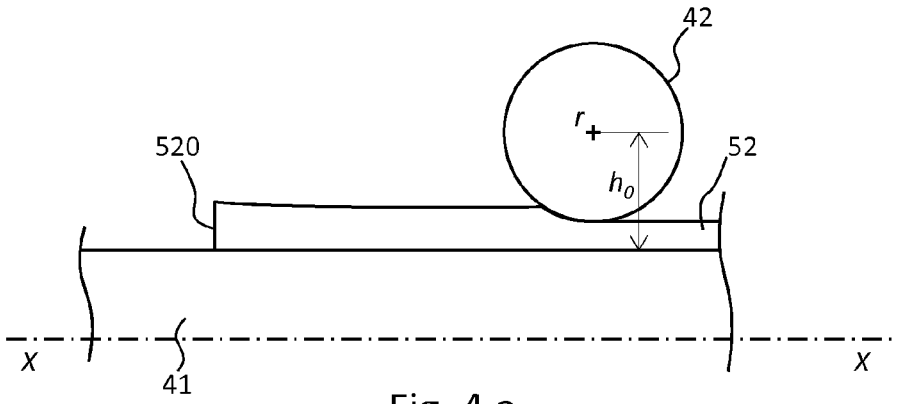
Fig. 4.a
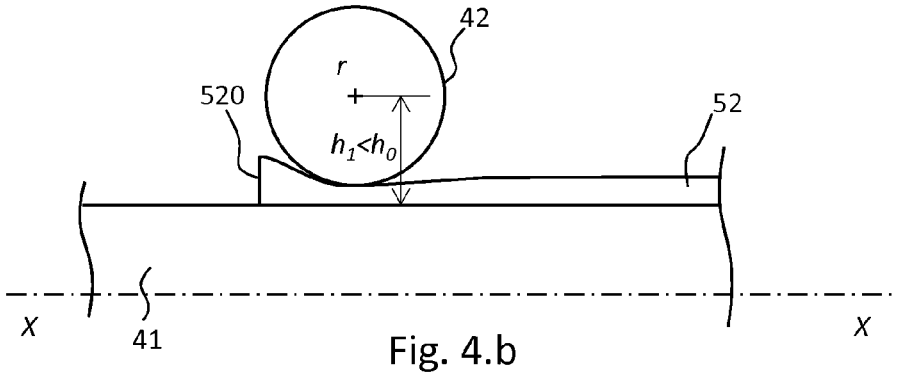
Fig. 4.b
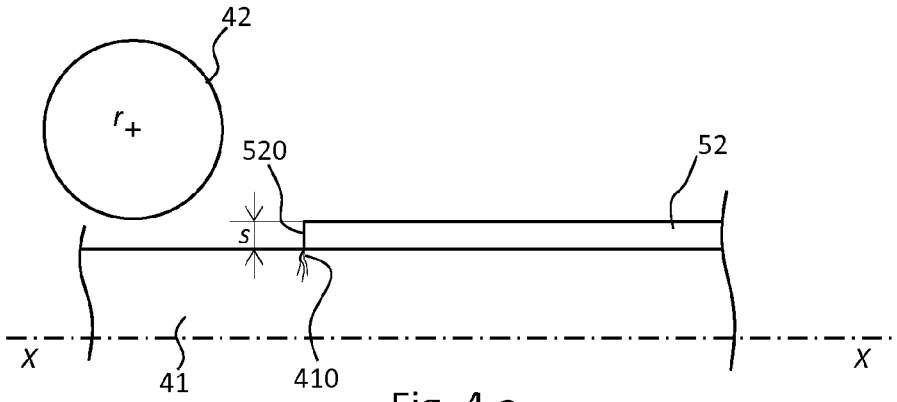
Fig. 4.c
PRIOR ART

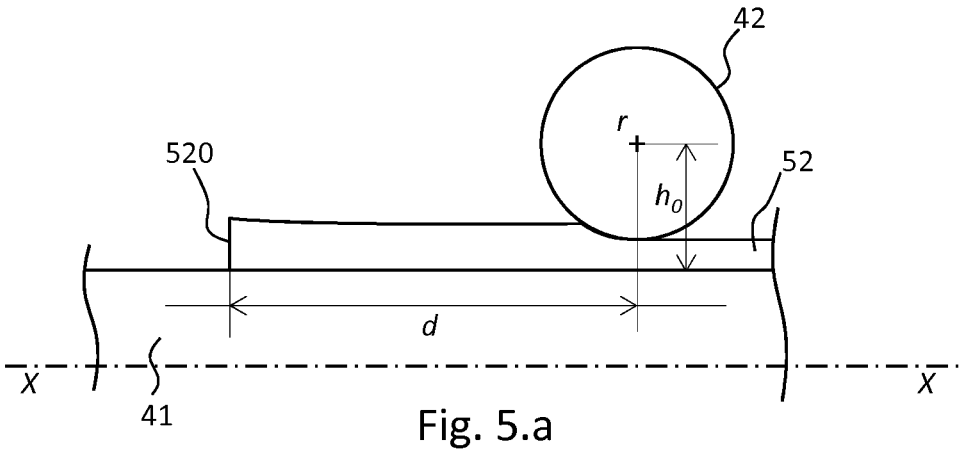
Fig. 5.a
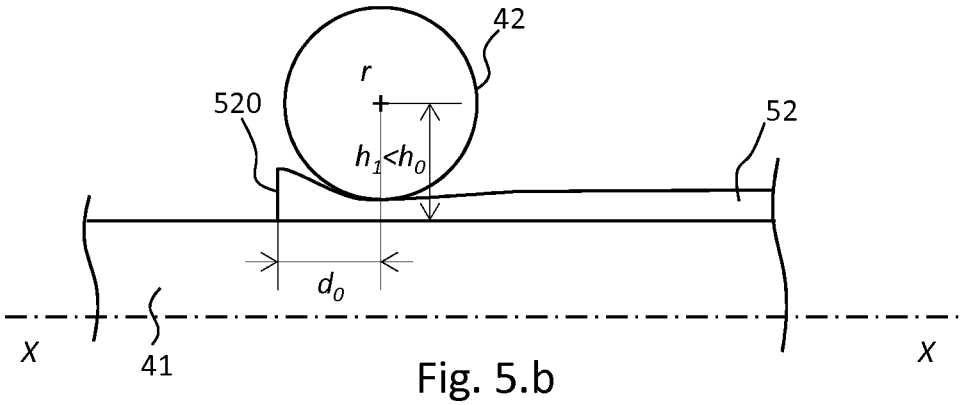
Fig. 5.b
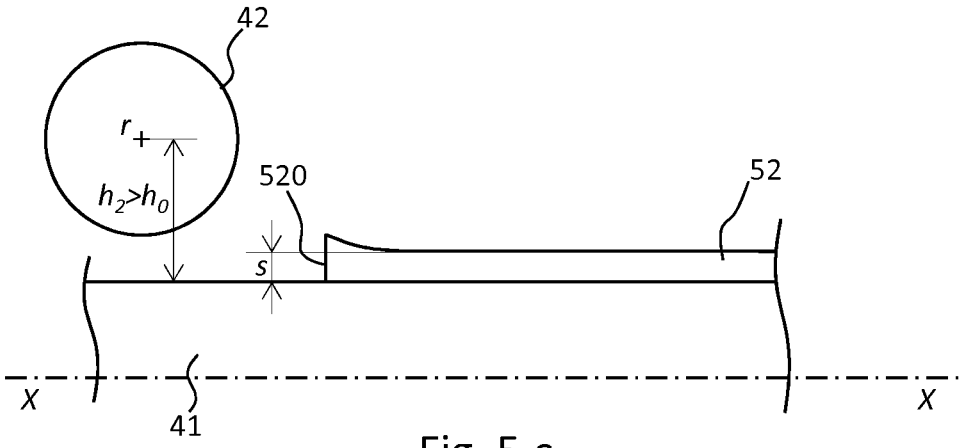
Fig. 5.c

ROLLING PLANT, ROLLING MILL AND ROLLING METHOD

This application is a National Stage of International Application PCT/IB2013/058076, filed Aug. 28, 2013, published Mar. 27, 2014, under PCT Article 21(2) in English; which claims the priority of Italian Application No. MI2012A001559, filed Sep. 19, 2012. The contents of the above-identified applications are incorporated herein by reference in their entireties.

The present invention relates to an improvement which can be made to a plant for rolling long hollow objects. More particularly the present invention relates to an improvement which can be made to a rolling plant comprising a continuous rolling mill of the type with four or more rolling stations, each with two or more radially movable rolls.

In the description below specific reference will be made, by way of a non-limiting example, to a seamless pipe rolling plant comprising a continuous rolling mill. This rolling mill, which is considered only by way of example, is of the retained-mandrel type and comprises six rolling stations, each of which comprises three radially movable rolls. It is therefore understood that the improvement according to the present invention may be likewise applied to rolling mills which are different, for example in terms of number of rolling stations and/or number of rolls present in each station.

A plant 10 of the known type (shown in schematic form in FIG. 1) usually comprises a rotary piercer, for example of the Mannesmann or Stiefel type. A station 30 for treatment of the pierced blank is situated immediately downstream of the rotary piercer, the entry point into the actual rolling mill 40 being situated beyond said station.

A billet 50, which may be usually heated beforehand, is fed to the rotary piercer 20. The rotary piercer is designed to pierce the billet and provide it with an initial axial elongation. The squat and internally hollow semifinished product 51 obtained therefrom is commonly called a pierced blank.

The pierced blank typically has a front end 510 (or "head") which has a regular form. The head in fact is the result of simple piercing of the front face of billet which is the first to be subjected to the piercing process. Conversely, the rear end 511 of the pierced blank (or "tail") is usually irregular since the effects of all the stresses and all the deformations generated by the piercing process accumulate there. The tail of the pierced blank is therefore often ragged and often comprises partially detached portions of material. These portions may assume different configurations, resulting in different defects which, depending on their specific configuration, may be called a "plume", "coin" or "onion ring".

Another important difference between the head and the tail of the pierced blank relates to the temperature upon leaving the piercer. In fact the head, which is processed firstly, comes into contact with the cold surfaces of the piercer and, once processed, has time to disperse into the surrounding environment part of the heat resulting from deformation. On the other hand, the tail is processed by the piercer when the surfaces of the latter have already been heated by the previous processing operation and, upon release, still retains all the heat. Basically, therefore, the tail is hotter than the head.

Downstream of the rotary piercer, in the proper station 30, the pierced blank undergoes a deoxidization treatment intended to prevent or in any case limit the formation of oxides on the inner surface of the pierced blank during conveying from the rotary piercer to the rolling mill.

Following this treatment, the pierced blank 51 is conveyed to the rolling mill and here engaged by the mandrel 41 which will support it during the rolling process, opposing from inside the action of the rolls.

Insertion of the mandrel 41 inside the pierced blank 51 usually occurs via the tail 511 which, as already mentioned above, often has various defects which may give rise to problems, also of a serious nature. For example the defects affecting the tail of the pierced blank may well consist, among other things, of fragments of material which are nearly entirely detached from the body of the pierced blank. If one of these fragments occupies even only partially the space where the mandrel accesses the pierced blank, it may easily get trapped between the mandrel and the pierced blank supported thereon. Since it has a smaller mass and is only partially connected to the body of the pierced blank, the fragment will generally also be much colder than the rest of the pierced blank. In this case the presence of the fragment during subsequent rolling will induce high local stresses on the mandrel and, at the same time, will leave an undesirable imprint on the inner wall of the pipe.

In order to reduce to a minimum the risks associated with insertion of the mandrel 41 into the tail of the pierced blank, the speed of the mandrel must be drastically reduced.

Passing through the main rolling mill 40, the pierced blank 51 is deformed by the successive action of the rolling stations 43 until a semifinished pipe 52 is obtained.

In the known rolling processes (shown schematically in FIGS. 3 and 4), the internal diameter of the semifinished pipe 52 is defined by the mandrel 41, while the desired thickness of the pipe wall is obtained by means of thinning of the thick walls of the pierced blank 51. The desired thinning is obtained by adjusting the radial position h of the rolling rolls 42 which press against the outer wall of the pipe.

Control over the radial position h of the rolls 42 is obtained by balancing the action of the forces which tend to move the rolls 42 towards the rolling axis X with the action of the forces which tend to move the rolls 42 away from this axis.

The forces which tend to move the rollers 42 towards the axis X are generated by special main actuators (not shown) which are usually hydraulic and each of which presses in the radial direction on a specific roll-holder device. The forces which tend to move the rolls 42 away from the axis X are instead generated both by the reaction of the pipe being rolled and by other auxiliary actuators (not shown), each of which is designed to ensure contact between a main actuator and the respective roll-holder device.

The forces generated by the main actuators, since they must produce the plastic deformation of the pipe being processed, are substantially greater than the forces generated by the auxiliary actuators.

Often the rolling process in turn results in the formation of irregular or even ragged zones on the tail of the semifinished pipe 52. It is therefore evident that, where the irregular zones caused by rolling are added to those previously introduced by the rotary piercing operation, the tail of the pipe may easily assume a condition where its mechanical integrity is uncertain. In these conditions therefore the risk of fragments of the tail becoming actually detached increases, such an event risking adversely affecting, even only temporarily, operation of the entire plant.

The pressure P acting on each roll 42 and designed to keep the radial position h fixed during rolling is obtained by controlling each main actuator on the base of a relatively complex logic which must take into account various factors.

For example, it is widely known that, all other conditions being equal, rolling of a hotter pipe section compared to a colder pipe section requires less radial pressure in order to obtain the same deformation.

It is therefore clear that the logic governing control of the pressure of the main actuators, and therefore the radial position h of the rolls, must take into account this factor and other factors in order to obtain a wall thickness s which is as constant as possible along the entire pipe 52.

Another factor which must be taken into account when defining the logic for controlling the actuators is the following: in the absence of any other specific corrective factor, maintaining the same radial position of the rolls (indicated by $h_0$ in FIG. 3) during rolling of the whole pipe results in a thickening 53 of the wall at the head and tail of the pipe itself. The phenomena which occur at the head and at the tail are different but have the same effect of producing thickened zones 53 and geometrical irregularities (or "flanges") on the terminal sections of the pipe 52.

At the front end of the pipe, when the latter enters into each station $\mathbf{43}_n$, the impact of the leading edge against the rolls 42 causes a pulsed displacement of the latter outwards. Immediately following impact the rolls reassume their correct position, but the radial displacement outwards is such that, in the vicinity of the leading edge of the pipe, the wall acquires a greater thickness than that desired.

At the tail end of the pipe the phenomenon (shown schematically in FIG. 3) is slightly more complex and is associated with the particular nature of the external constraints acting on that specific pipe section during rolling thereof. All the central sections of the pipe 52 are in fact rolled by each station $\mathbf{43}_n$, while the adjacent section is still being processed, and is therefore constrained, inside the preceding station $\mathbf{43}_{n-1}$. On the other hand, the tail section of the pipe is always rolled by each station $\mathbf{43}_n$ in a less constrained condition, having already been released by the preceding station $\mathbf{43}_{n-1}$ and not having any other pipe section attached thereto. The final effect of this phenomenon is similar to that described for the head and results in undesirable thickening 53 of the wall in the tail section of the pipe 52.

As regards the tail end of the pipe 52 therefore the thickening 53 of the wall with respect to the desired thickness s is added to the presence of defects arising at the moment of piercing of the billet 50.

The simplest solution to these problems is to cut the head and tail sections where they exceed a maximum tolerance in relation to the desired thickness s of the wall of the pipe 52.

This solution, apart from being simple, is also however somewhat costly because it results in a not insignificant percentage amount of ready-processed material being wasted. It should be considered in fact that, in the case of a finished pipe of 80-100 meters length, the total amount of waste material for both head and tail may be as much as 3 meters, i.e. about 3% of the length. It should also be considered that this waste material, when expressed in terms of mass, reaches percentages values which are even greater, precisely owing to the greater thickness of these sections.

Another solution commonly used to solve this type of problem (shown schematically in FIG. 4) is that of adopting a so-called tapering method. This method envisages moving the rolls 42 towards the rolling axis X precisely at the end sections, i.e. head and tail, of the pipe 52, as if to impart a wall thickness which is smaller than s. This is shown in FIG. 4.*b*, where the distance between the axis r of the roll and the mandrel 41 is indicated by $h_1$, which is smaller than $h_0$. The net effect on the pipe 52 of these two phenomena, i.e. spontaneous thickening on the one hand and tapering imparted by the rolls on the other hand, is that of obtaining a regular wall thickness (see FIG. 4.*c*).

It has been found, however, that tapering, although fairly effective, has however another major drawback. In fact the greater pressure produced on the tail section gives rise to a particularly severe thermal and mechanical stress condition for the mandrel 41, in particular in certain zones. The zones of the mandrel where this phenomenon becomes particularly critical are those which cooperate with the last stations for rolling the tail section.

In particular, considering a typical six-station rolling mill, the sixth station $\mathbf{43}_6$ performs a fairly light rolling action, which is intended more than anything else to provide a uniform finish for the outgoing pipe. On the other hand, a much more pronounced rolling action is performed by the fourth station $\mathbf{43}_4$ and fifth station $\mathbf{43}_5$. Since the sections of the mandrel 41 involved in this rolling operation reach their position after having already undergone rolling by the first three stations $\mathbf{43}_{1\text{-}3}$, their thermal and mechanical stress condition is already fairly critical. The further increase in the radial pressure, intended to avoid thickening 53 of the wall of the pipe 52 in the tail section, makes this stressed state of the mandrel even more critical.

A further worsening of the stressed state of the mandrel is caused by the discontinuity of the trailing edge 520 of the pipe 52. The step formed by the trailing edge of the pipe has the effect of concentrating the stresses and increases the effect of the pressure exerted by the rolls 42, through the pipe 52, on a specific area 410 of the mandrel 41.

These severe stress peaks have the effect of creating, on the wall of the mandrel 41, a significant state of wear after a relatively small number of cycles.

This precocious wear of the mandrel is a major problem since the mandrel itself has a very high cost in relation to the overall cost of the plant. In fact both the purchase of a new mandrel and reconditioning of a worn mandrel are very costly, the latter process being a fairly complex process which comprises the steps of checking the mandrel, remachining it (where possible, i.e. in the case of mandrels where the diameter can be reduced to a smaller size which may in turn be industrially utilizable), preparation of the surface, renewed chrome-plating, etc. Since often reconditioning must be carried out by external contractors, in addition to the costs associated with the technical repair operations, it is also necessary to take into account the costs and time involved for operations of a logistical nature, namely the disassembly, handling and transportation of the mandrels, which have a considerable size and weight.

The overall effect of tapering is therefore that of reducing the percentage amount of waste in relation to the pipes produced on the one hand, but also that of drastically increasing the plant management costs on the other hand.

As has been seen therefore, although widely used and recognized, the rolling plants 10 of this type are not without drawbacks.

The object of the present invention is therefore to provide an improvement to the rolling plants which is able to overcome at least partly the drawbacks mentioned hereinabove with reference to the prior art.

In particular, a task of the present invention is to provide an improvement for rolling plants which solves the problems associated with the irregular zones and defects which typically affect the tail of the pierced blank.

Moreover, another task of the present invention is to provide an improvement for rolling plants which solves at least partly the problem of precocious wear of the mandrel.

Finally, another task of the present invention is to provide an improvement for rolling plants which may be applied to the existing plants without involving a huge financial outlay.

This object and these tasks are achieved by means of the rolling plant according to claim 1, by means of the rolling mill according to claim 3 and by means of the rolling methods according to claims 2 and 4.

In order to understand more fully the invention and appreciate its advantages, a non-limiting example of embodiment thereof is described below with reference to the accompanying drawings in which.

FIGS. 3.*a*, 3.*b* and 3.*c* show schematically three rolling steps according to a known method;

FIGS. 4.*a*, 4.*b* and 4.*c* show schematically three rolling steps according to a known method;

FIGS. 5.*a*, 5.*b* and 5.*c* show schematically three rolling steps according to a method of the invention.

In the accompanying figures, the reference number 10 denotes in its entirety a plant for rolling long hollow objects, typically seamless pipes.

Figure 1:
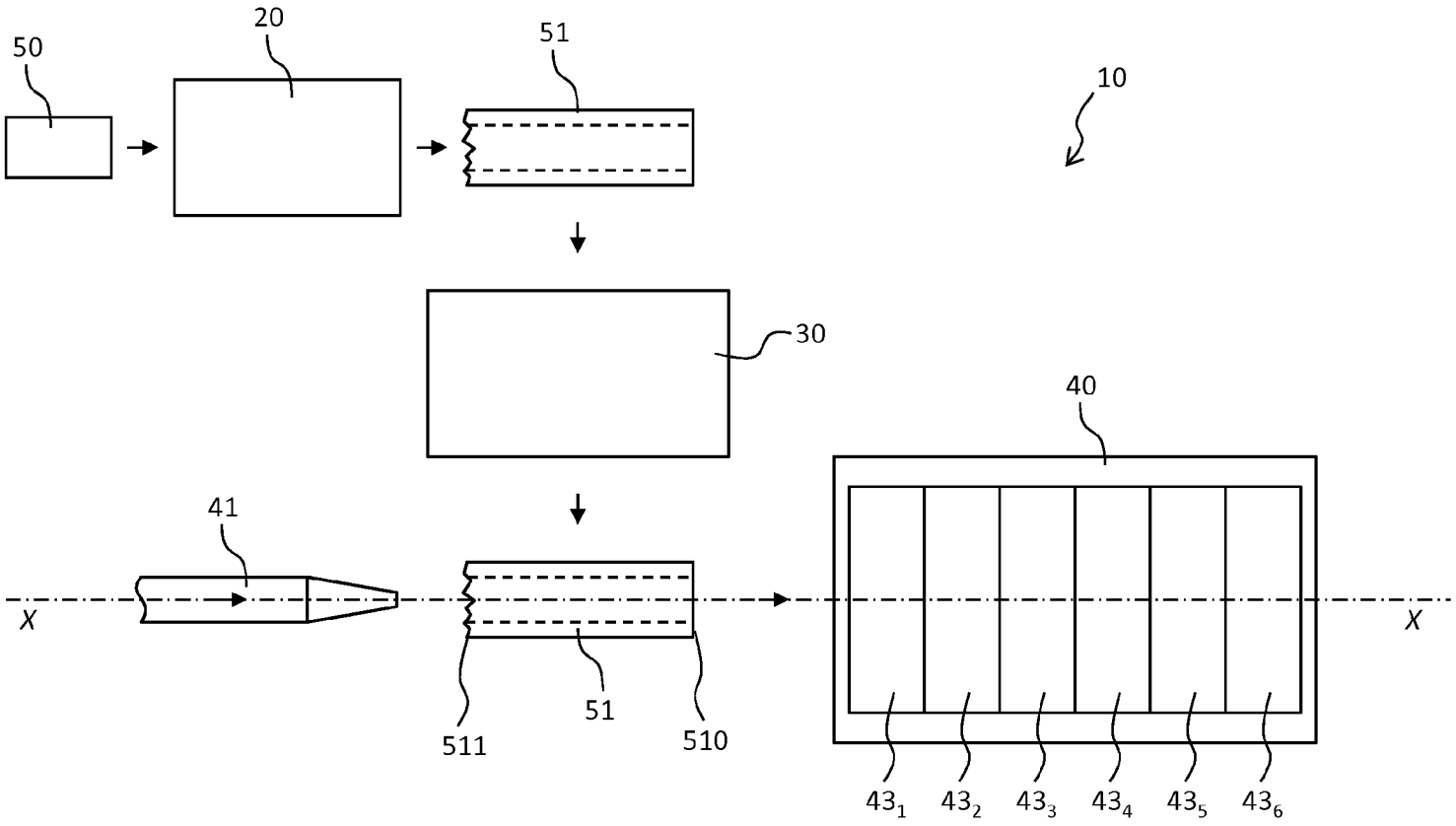
PRIOR ART Fig. 1
FIG. 1 shows a schematic plan view of a rolling plant according to the prior art.
Figure 2:
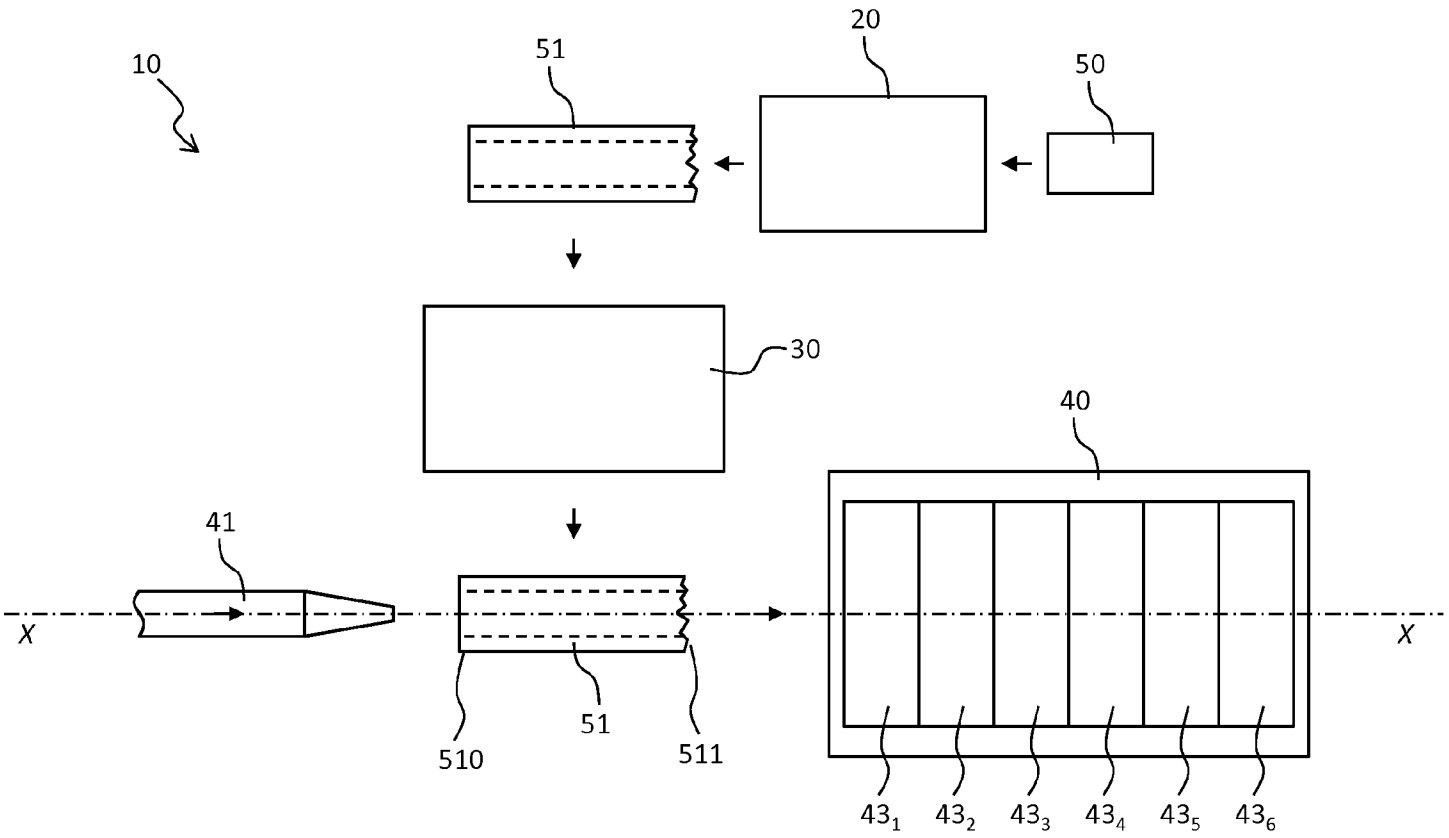
FIG. 2 shows a schematic plan view of a rolling plant according to the invention.

The plant 10 according to the invention, as shown in FIG. 2, comprises: a rotary piercer 20, a station 30 for treating the pierced blank 51 and a main rolling mill 40.

The rotary piercer 20 is designed to receive a billet 50 at its inlet and to pierce it longitudinally so as to obtain a pierced blank 51 with a regular head 510 and a (frequently) irregular tail 511.

The station 30 is designed to carry out a deoxidization treatment of the pierced blank 51.

The main rolling mill 40 comprises a plurality of rolling stations 43 and is designed to receive at its inlet the pierced blank 51 and to roll the pierced blank 51 on the mandrel so as to obtain a semifinished pipe 52.

The rotary piercer 20 and the treatment station 30 are arranged so that the pierced blank 51 leaving them:

- is arranged with its longitudinal axis substantially parallel to the rolling axis X of the main rolling mill 40; and
- is arranged between the tip of the mandrel 41 and the first station $\mathbf{43}_1$ of the main rolling mill 40.

In the plant 10 according to the invention, the rotary piercer 20 and the treatment station 30 are also arranged so that the pierced blank 51 leaving them is arranged with the irregular tail 511 facing the first station $\mathbf{43}_1$ of the main rolling mill 40 and with the regular head 510 facing the tip of the mandrel 41.

As mentioned above, the tail 511 of the pierced blank 51 often (but not always) has an irregular form. It should be noted however that with the plant according to the invention it is possible to roll any pierced blank, irrespective of the conditions of the tail 511. In other words, with the plant 10 according to the invention it is possible to achieve significant advantages compared to a conventional plant, in the frequent case where the tail 511 is irregular or even ragged. At the same time, however, the plant 10 according to the invention does not give rise to any disadvantage in those rare cases where the tail 511 has a regular form.

According to another aspect, the invention also relates to a method for rolling long hollow objects. The method according to the invention comprises the steps of:

providing a billet 50;

piercing the billet 50 longitudinally by means of a rotary piercer 20 so as to obtain a pierced blank 51 with a regular head 510 and a tail 511 which is often irregular;

subjecting the pierced blank 51 to a deoxidization treatment;

inserting a mandrel 41 into the pierced blank 51;

rolling the pierced blank 51 on the mandrel in a main rolling mill 40 so as to obtain a semifinished pipe 52.

In the method according to the invention, moreover, the mandrel 41 is inserted inside the pierced blank 51 via the regular head 510, and the irregular tail 511 of the pierced blank 51 is introduced firstly into the main rolling mill 40.

As the person skilled in the art will appreciate, with the plant 10 and the rolling method according to the invention it is possible to overcome some of the drawbacks mentioned above with reference to the prior art. In particular, the fact of introducing the mandrel 41 inside the pierced blank 51 via the head 510, which is always regular, involves the significant advantage of eliminating any risk associated with the possibility of a cold fragment being inserted between the mandrel 41 and the inner wall of the pipe 52 being rolled.

Moreover, the particular orientation of the pierced blank 51 is such that the irregular and/or ragged zones caused by the rolling process are not combined with those arising previously from the rotary piercing operation. In fact, the irregular zones due to rotary piercing are located on the tail of the pierced blank 51 which subsequently forms the front end of the pipe 52. On the other hand, the tail end of the pipe is obtained from the head of the pierced blank which is always regular. The final effect is therefore that of drastically reducing the possibility that pipe fragments may become detached during rolling, thereby adversely affecting correct operation of the entire plant.

According to a further aspect, the invention also relates to a rolling mill 40 for rolling a semifinished pipe 52.

The rolling mill 40 according to the invention comprises a plurality of rolling stations $\mathbf{43}_{1\text{-}6}$ arranged along a rolling axis X, wherein each rolling station $\mathbf{43}_n$ comprises a plurality of rolling rolls 42 which are rotatable about respective axes of rotation r, the radial position of which is adjustable by means of actuators.

The rolling mill 40 also comprises a control circuit suitable for controlling the radial position h of the rolling rolls 42 so as to obtain for the wall of the semifinished pipe 52 a thickness s which is as constant as possible along the rolling axis X and is as similar as possible to a desired thickness.

In the rolling mill 40 according to the invention, the control circuit comprises means suitable for calculating and/or measuring, projected along the rolling axis X, the distance d between the axes of rotation r of the rolls 42 of each rolling station $\mathbf{43}_n$ and the trailing edge 520 of the pipe 52.

In the rolling mill 40 according to the invention moreover the control circuit is designed to displace the rolling rolls 42 radially towards the outside of the semifinished pipe 52 in each rolling station $\mathbf{43}_n$ when the distance d assumes a predetermined value $d_0$. This is shown in FIGS. 5.*b* and 5.*c*, where the distance between the axis r of the roll and the mandrel 41 is reduced from $h_0$ to $h_1$ as for normal tapering, but upon reaching the distance $d_0$ immediately changes from $h_1$ to $h_2 > h_0$.

According to yet another aspect, the invention also relates to a second method for rolling long hollow objects 51, 52 comprising the steps of:

providing a pierced blank 51;

inserting a mandrel 41 into the pierced blank 51;

providing a main rolling mill 40 comprising a plurality of rolling stations $\mathbf{43}_{1\text{-}6}$, each rolling station $\mathbf{43}_n$ comprising a plurality of rolling rolls 42 which are rotatable about respective axes of rotation r, the radial position h of which is adjustable by means of actuators;

rolling the pierced blank 51 on the mandrel in the main rolling mill 40 so as to obtain a semifinished pipe 52.

The radial position h of the rolling rolls 42 is controlled so as to obtain for the wall of the semifinished pipe 52 a thickness s which is as constant as possible along the rolling axis X and is as similar as possible to a desired thickness.

The second method according to the invention also comprises the steps of:

calculating and/or measuring the distance d, projected along the rolling axis X, between the axes of rotation r of the rolls 42 of each rolling station $\mathbf{43}_n$ and the trailing edge 520 of the pipe 52; and displacing the rolling rolls 42 radially towards the outside of the semifinished pipe 52 in each rolling station $\mathbf{43}_n$ when the distance d assumes a predetermined value $d_0$.

The means designed to calculate and/or to measure the distance d between the axes r and the trailing edge 520 may comprise sensors, of the type known per se, able to recognize and track the position of the trailing edge 520 during its movement along the rolling axis X.

Instead of or in addition to the sensors, the means designed to calculate and/or to measure the distance d may comprise sensors, of the type known per se, able to recognize the pressure peak which is recorded in each station 53 when the trailing edge 520 of the pipe 52 passes underneath the rolling rolls 42. It should also be noted here that, in addition to the interaxial distance between two successive stations which is obviously precisely known, the speed of feeding of the pipe 52 along the plant is also known. This speed may in fact be detected by special sensors or may also be calculated by the ratio between the length of the pipe 52 (which increases by a known factor in each station 43) and the rolling time (which is instead constant for all the stations 43). Knowing therefore the moment when the trailing edge 520 leaves the station $\mathbf{43}_{n-1}$ as well as the interaxial distance and the speed of the pipe, it is possible to calculate in real time the distance d between the trailing edge 520 and the axis r of the rolls of the following station $\mathbf{43}_n$.

As the person skilled in the art will have been able to readily appreciate from the above description, with the rolling mill 40 and the second rolling method according to the invention significant advantages may be achieved compared to the prior art.

The interruption of tapering in the vicinity of the trailing edge 520 of the pipe 52 allows in fact to protect the mandrel from the precocious wear which occurs with the conventional tapering method. The method according to the invention in any case produces an end section of the pipe which must be cut and discarded because it has a thickness which exceeds the permitted tolerance. This section, however, would have to be removed in any case owing to the irregularities arising from rolling; moreover the length of the thicker section is not determined by spontaneous and therefore random phenomena, but is determined by the control circuit and is therefore equal to about $d_0$.

Obviously, a person skilled in the art, in order to satisfy any specific requirements which might arise, may make to the plant 10, the rolling mill 40 and the methods according to the present invention further modifications and variations, all of which being moreover contained within the scope of protection of the invention, as defined by the following claims.

The invention claimed is:

1. A plant (10) for rolling long hollow objects (51, 52) on a mandrel (41), comprising:

a rotary piercer (20) that receives at its inlet a billet (50) and pierces the billet (50) longitudinally so as to obtain a pierced blank (51) having a regular head (510) and an irregular tail (511);

a station (30) for treating the pierced blank (51) to a deoxidation treatment;

a main rolling mill (40) comprising a plurality of rolling stations (43) that receives at its inlet the pierced blank (51) and rolls the pierced blank (51) on a mandrel so as to obtain a semifinished pipe (52);

wherein the rotary piercer (20) and the treatment station (30) are arranged so that the pierced blank (51) leaving them:

is arranged with a longitudinal axis of the pierced blank substantially parallel to the rolling axis X of the main rolling mill (40); and is arranged between the tip of the mandrel (41) and the first station ($\mathbf{43}_1$) of the main rolling mill (40);

and the rotary piercer (20) and the treatment station (30) are furthermore arranged so that the pierced blank (51) leaving them is arranged with the irregular tail (511) facing the first station ($\mathbf{43}_1$) of the main rolling mill (40) and with the regular head (510) facing the tip of the mandrel (41).

2. The rolling plant (10) according to claim 1, wherein the plurality of rolling stations ($\mathbf{43}_{1\text{-}6}$) are arranged along a rolling axis X, each rolling station ($\mathbf{43}_n$) comprising a plurality of rolling rolls (42) rotatable about respective axes of rotation (r), the radial position h of which is adjustable by means of actuators;

the rolling mill (40) also comprises a control circuit for controlling the radial position h of the rolling rolls (42) so as to obtain for the wall of the semifinished pipe (52) a substantially constant thickness (s) along the rolling axis X;

wherein said control circuit comprises means suitable for calculating and/or measuring, projected along the rolling axis X, the distance d between the axes of rotation r of the rolls (42) and the trailing edge (520) of the pipe (52);

and said control circuit is designed to displace the rolling rolls (42) radially towards the outside of the semifinished pipe (52) in each rolling station ($\mathbf{43}_n$) when the distance d assumes a predetermined value $d_0$.

3. A method for rolling long hollow objects (51, 52) comprising the steps of:

providing a billet (50);

piercing the billet (50) longitudinally by means of a rotary piercer (20) so as to obtain a pierced blank (51) having a regular head (510) and an irregular tail (511);

subjecting the pierced blank (51) to a deoxidization treatment;

inserting a mandrel (41) into the pierced blank (51);

rolling the pierced blank (51) on a mandrel in a main rolling mill (40) so as to obtain a semifinished pipe (52);

wherein the mandrel (41) is inserted inside the pierced blank (51) via the regular head (510), and the irregular tail (511) of the pierced blank (51) is introduced firstly into the main rolling mill (40).

4. The rolling method according to claim 3, wherein the main rolling mill (40) comprises a plurality of rolling stations ($\mathbf{43}_{1\text{-}6}$), each rolling station ($\mathbf{43}_n$) comprises a plurality of rolling rolls (42) which are rotatable about respective axes of rotation r, the radial position h of which is adjustable by means of actuators; and the radial position h of the rolling rolls (42) is controlled so as to obtain for the wall of the semifinished pipe (52) a substantially constant thickness (s) along the rolling axis X;

the method further comprises the steps of:

calculating and/or measuring the distance d, projected along the rolling axis X, between the axes of rotation r of the rolls (42) of each rolling station (43$_n$) and the trailing edge (520) of the pipe (52); and displacing the rolling rolls (42) radially towards the outside of the semifinished pipe (52) in each rolling station (43$_n$) when the distance d assumes a predetermined value $d_0$.

* * * * *